US005249810A

United States Patent [19]

Cazalet

[11] Patent Number: 5,249,810

[45] Date of Patent: Oct. 5, 1993

[54] COUNTING PADDLE TOY

[76] Inventor: Henry Cazalet, 14 Elmhurst Dr., Old Westbury, N.Y. 11568

[21] Appl. No.: 972,307

[22] Filed: Nov. 5, 1992

[51] Int. Cl.[5] ..... A63B 67/20

[52] U.S. Cl. ..... 273/330

[58] Field of Search ..... 273/329, 330, 331, 333, 273/334, 335, 67 R, 413, 414

[56] References Cited

U.S. PATENT DOCUMENTS

| | | | |
|---|---|---|---|
| 713,316 | 11/1902 | Lawrence | 273/330 X |
| 1,293,566 | 2/1919 | Snyder | 273/334 |
| 1,928,583 | 9/1933 | Young et al. | 273/330 |
| 2,047,744 | 7/1936 | Paul et al. | 273/330 |
| 2,159,817 | 5/1939 | Pierce | 273/330 X |
| 2,250,802 | 7/1941 | Johnston | 273/330 |
| 2,736,557 | 2/1956 | Androsiglio | 273/330 |
| 2,817,188 | 12/1957 | Jefferson | 273/330 X |
| 2,978,248 | 4/1961 | Harris | 273/330 |
| 3,358,999 | 12/1967 | Lerner et al. | 273/330 |
| 4,222,563 | 9/1980 | Heftler et al. | 273/67 R |

*Primary Examiner*—William H. Grieb
*Attorney, Agent, or Firm*—Michael I. Kroll

[57] ABSTRACT

The present invention relates to an electronic counting paddle toy. The electronic counting paddle toy includes a rigid paddle comprising a first side and a second side which is identical to and separate from the first side and contained in its hollow middle is a plurality of sound conducting posts, an elastic removably tether, a resilient ball, an electronic counter that works off the sound created when the ball hits the paddle, a display, wherein the tether elastically connects the paddle and the ball and wherein each impact of the ball with the paddle sounds and is counted and wherein the count is shown on the display, and structure for detecting the impact of the ball with the paddle thereby causing the counter to index upward.

11 Claims, 2 Drawing Sheets

DRIVER

Fig. 4
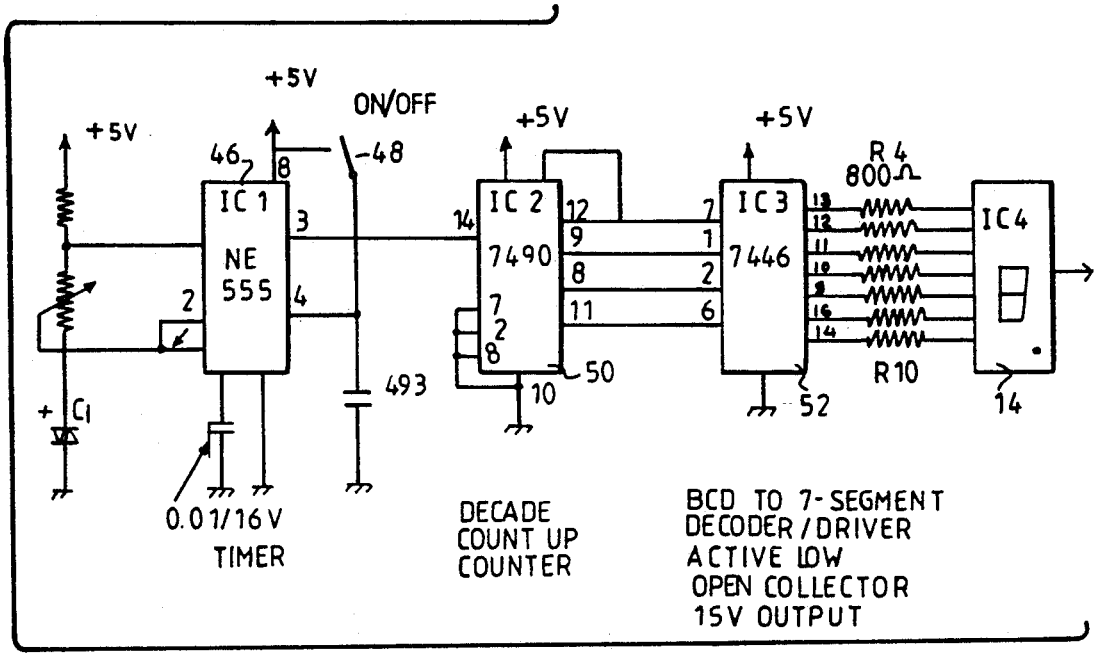
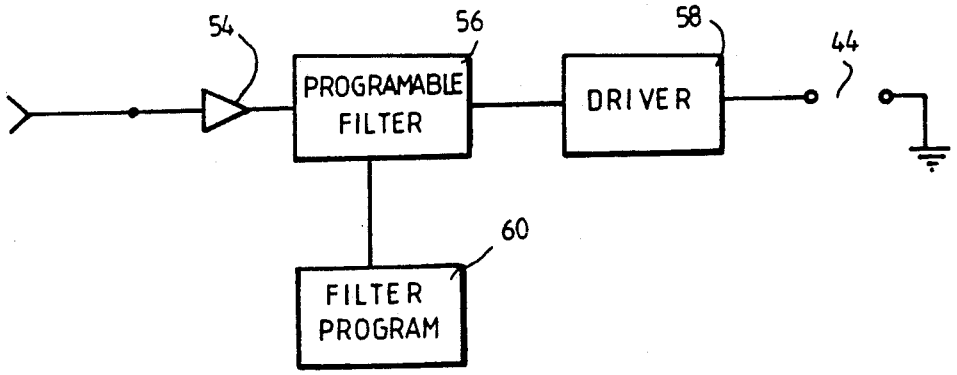
Fig. 7

COUNTING PADDLE TOY

BACKGROUND OF THE INVENTION

1. Field of the Invention

The present invention relates to the field of amusement devices.

More particularly, the present invention relates to the field of paddle toys.

2. Description of the Prior Art

In the United States and around the world, paddle toys have become universally adopted and enjoyed. One ubiquitous toy consists of a paddle to which is tethered a resilient ball. The tether itself is elastic. The object of games played with such toys is to have the ball bounce away from the paddle and then have the ball return to the paddle repeatedly without missing the paddle. In competitive situations, two or more people may play with such paddles. The skill level achieved is determined by counting the number of times in succession that the ball impacts with the paddle without missing it.

At the present state of the art, the user of such paddles must resort to either mentally counting the number of impacts or using some clumsy mechanical device to do so. This increases the likelihood for error and tends to distract the user so that he may never achieve the maximum skill level possible.

A number of inventions have been proposed that deal with the structure and use of paddle toys. For instance improvements offer in: G.M. Young, et al. (U.S. Pat. No. 1,928,583), L.R. Paul et al. (U.S. Pat. No. 2,047,744), F.H. Pierce (U.S. Pat. No. 2,159,817), E. Jefferson (U.S. Pat. No. 2,817,188), L.S. Harris (U.S. Pat. No. 2,978,248), do not contain any counting means. Improved paddles in: D.S. Johnston (U.S. Pat. No. 2,250,802), L Androsiglio (U.S. Pat. No. 2,736.557), and G. Lerner et al. (U.S. Pat. No. 3,358,999) offer mechanical counters which are far bulkier and far more difficult to use than the electronic display of the instant invention. T. Heftler et al. (U.S. Pat. No. 4,222,563) provides a paddle that electronically displays impact to a paddle, but does not develop the toy into a paddle device with tethered ball.

SUMMARY OF THE INVENTION

Accordingly, it is an object of the present invention to provide a counting paddle toy that avoids the disadvantages of the prior art.

In keeping with these objects, and with others which will become apparent hereinafter, one feature of the present invention resides, briefly stated, in an electronic counting paddle toy, including a rigid paddle comprising a first side of and a second side which is identical to and separate from the first side and contained in its hollow middle is a plurality of sound conducting posts, an elastic removably tether, a resilient ball, an electronic counter that works off the sound created when the ball hits the paddle, a display, wherein the tether elastically connects the paddle and the ball and wherein each impact of the ball with the paddle sounds and is counted and wherein the count is shown on the display, and means for detecting the impact of the ball with the paddle thereby causing the counter to index upward.

In accordance with another feature of the present invention, the counter and display comprise a counter that generates a stream of square waves when switched on, a decade counter that converts the stream of square waves into a binary coded signal, a decoder/driver that converts the binary coded signal into a multiplicity of voltages needed to drive a display, and a display driven by the voltages.

Another feature of the present invention is that the counter comprises a type 555 integrated circuit, the decade counter comprises a type 7490 decade count up counter integrated circuit, and the decoder/driver comprises a type 7446 BCD to 7-segment decoder/driver integrated circuit.

Yet another feature of the present invention is that the means for detecting the impact of the ball with the paddle creating a sound and thereby causing the counter to count upward comprise a sound transducer located inside the paddle, a circuit for amplifying the output of the transducer, such that a vibration from the impact of the ball with the paddle is caused.

Still another feature of the present invention is that the means for detecting the impact of the ball with the paddle thereby causing the counter to index upward comprise a sound transducer, a circuit for amplifying the output of the transducer, a circuit for amplifying the output of the transducer, a circuit for processing the signal such that only certain vibrations are amplified, and a circuit that takes the processed output such that the vibration of the impact of the ball with the paddle causes vibrations that create sound.

Yet still another feature of the present invention is that the circuit for processing the signal such that only certain vibrations are amplified comprises a programmable filter, and a filter program, such that only sounds of a desired frequency corresponding to ball impact and pass through the filter.

Still yet another feature of the present invention is that the hollow body allows the sound to resonate in an amplification chamber which makes the sound reverberate.

Another feature of the present invention is that the tether removable by providing an aperture in the center of the paddle for the tether to pass through, a screw and a washer in the immediate area of the tether aperture which would allow the tether to be wrapped around or compressed between the surface of the paddle and the underside of the washer when the screw is tightened into the threaded hole, this compression would hold the tether in place.

Yet another feature of the present invention is that it further comprises a sound generator such that the impact of the ball causes the sound generator to emit a sound.

Still another feature of the present invention is that the sound generator is a voice synthesizer.

Yet still another feature of the present invention is that the vibrations are conducted to the sound sensor via a multiplicity of sound-conducting ribs.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

The figures of the drawings are briefly described as follows:

FIG. 4 is an electronic circuit diagram showing the counter portion of the present invention;

FIG. 7 is a block diagram of a second embodiment in which programmable filtering has been added to eliminate the counting of vibrations not caused by ball/paddle impact.

LIST OF REFERENCE NUMERALS UTILIZED IN THE DRAWING

Figures 1, 2, 2A, 3, 3A, 5, 6:
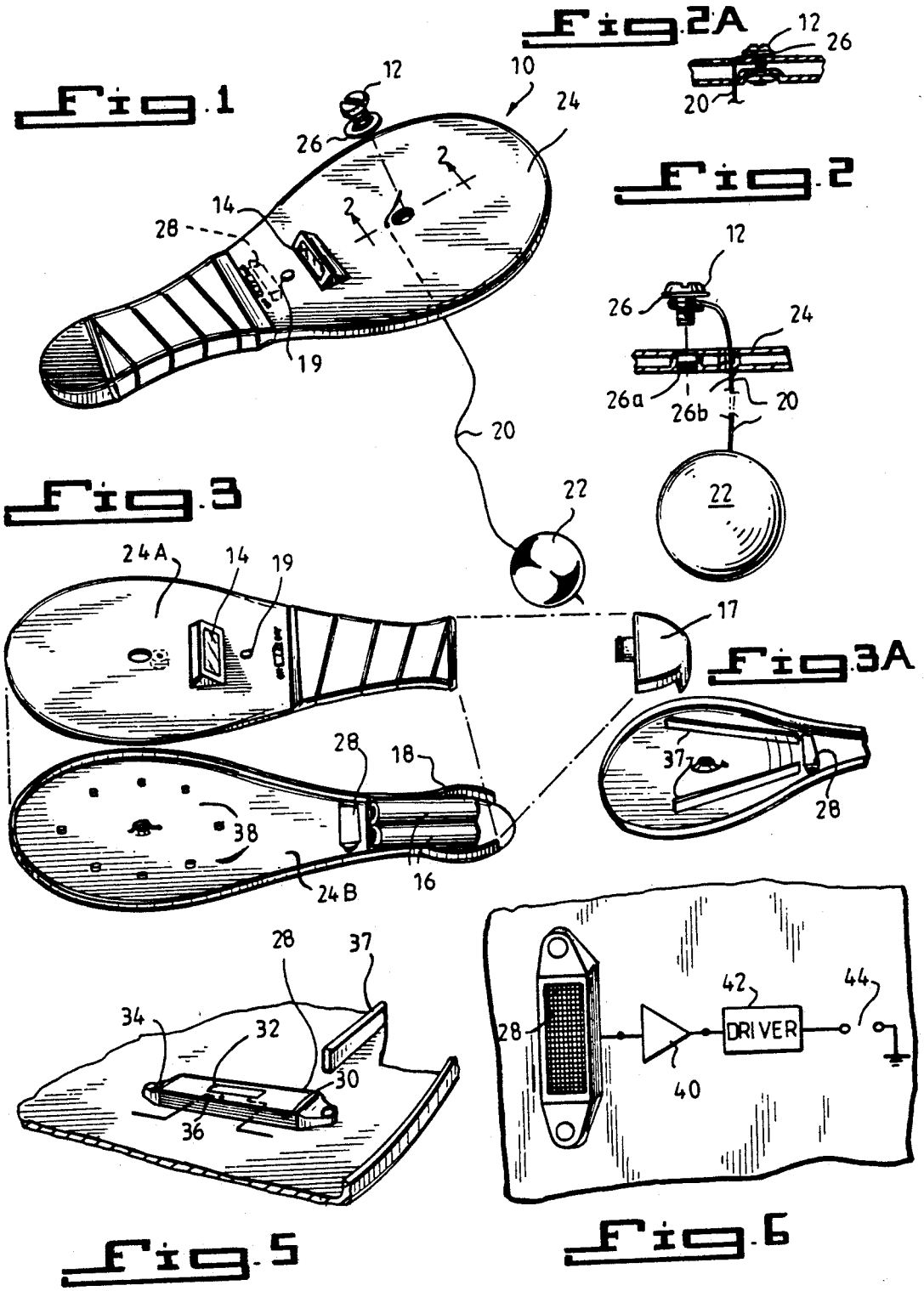
FIG. 1 is a perspective view of the present invention showing the display side of the paddle.
FIG. 2 is a cross-sectional view taken on 2—2 of FIG. 1, showing the tether installed.
FIG. 2A is a similar cross-sectional view showing the installation of the tether.
FIG. 3 is an exploded perspective view of the invention showing the use of posts to conduct sound vibrations.
FIG. 3A is a similar view showing the use of sound-conducting ribs.
FIG. 5 is a partial view of inside of the paddle showing the mounting of the microphone component.
FIG. 6 is an electronic block diagram of the input circuit.

12: screw
14: electronic display
16: battery
17: battery access hatch cover
18: battery holder
19: impact indicating lamp
20: elastic tether
22: resilient ball
24: rigid paddle
24A: top half of rigid paddle
24B: bottom half of rigid paddle
26: washer
26A: threaded aperture
26B: centerline for screw
28: microphone mount
30: microphone connection
32: microphone
34: microphone mounting hole
36: microphone connection
37: sound conducting rib
38: sound conducting posts
40: amplifier IC
42: Driver IC
46: NE555 timer IC
48: timer switch contact
50: 7490 counter IC
52: 7446 decoder/driver IC

DETAILED DESCRIPTION OF THE PREFERRED EMBODIMENT

The general operation of the present invention is best understood with reference to FIGS. 1, 2, 2A, 3, 3A and 5. The invention 10 is a paddle counting toy with a rigid paddle 24 with top half 24A and bottom half 24B, to which is connected an elastic tether 20 and a resilient ball 22. When ball 22 impacts paddle 24 the paddle vibrates. This vibration is detected by sensor/transducer 28. These sound vibrations may be transmitted from the paddle surface to sensor 28 via sound-conducting posts such as 38 in FIG. 3 or via sound-conducting ribs such as 37 in FIG. 3A. Through means to be discussed below, these sound vibrations cause electronic display 14 to indicate the number of times the ball has hit the paddle. The display and circuitry are powered by batteries 16 contained in battery holder 18. To change batteries 16, battery access hatch cover 17 is removed. The hole for the tether 20 should be ⅜ of an inch below the center line for the nut hole. There are seven posts inside the paddle to receive the seven screws to hold the paddle together.

If tether 20 needs to be replaced, screw 12, which goes through washer 26 is removed. This releases tether 20 so that a new tether can be inserted into the hole 21 and wrapped around screw 12. Screw 12 is then screwed into threaded hole 26B.

The operation of the electronic portion of the present invention is best understood with reference to FIGS. 4 and 6. The operation of the counter itself is best understood with reference to FIG. 4. In FIG. 4, timer chip 46, type NE555, outputs a series of pulses each time switch contacts 48 are closed. These pulses are input to decade counter chip 50, type 7490, and the decade counter outputs a binary analog of the number of times the switch 48 has been pulsed. The output of counter 50 is then input to BCD to 7-segment decoder/driver chip 52, type 7446, whose output is capable of driving and displaying 14. In this example, the display is a light emitting diode (LED) display, but if the decoder/driver is altered, any other kind of display may be used, including, but not limited to, sound, liquid crystal, electroluminescent, electroflourescent, and gas plasma. For the sake of simplicity, only a single digit is shown, but anyone experienced in the art can easily extend this to any number of digits.

A first embodiment, illustrated in FIG. 6, uses microphone 28 to provide sufficient sensitivity such that even if the ball strikes lightly it will operate the counter. The output of microphone 28 is input to amplifier 40 and output of 40 is sufficient to operate driver circuit 42 which causes a switch closure across 44 so that when the ball strikes the counter is incremented.

A second embodiment, illustrated in FIG. 7, provides the advantage of only actuating when a vibration is caused by the impact of the ball against the paddle. In this embodiment, the microphone is input to amplifier 54 whose output, in turn, is input to programmable filter 56. The frequency response of this filter is determined by parameters stored in filter program 60. This filter is capable of being programed both for filter selectivity and frequency centering. The output of the programmable filter is used by driver 58 to cause switch closure across 44.

The sound of the ball striking the paddle creates a sound variation which is received by a sound sensor which in turn creates an electronic impulse that moves the L.E.D. counter one score unit for each impulse. The present invention incorporates the use of sound to register the scoring unit. The sensor is inside the paddle since the paddle is hollow.

It will be understood that each of the elements described above, or two or more together, may also find a useful application in other types of constructions differing from the type described above.

While the invention has been illustrated and described as embodied in a counting paddle toy, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An electronic counting paddle toy, comprising:

a) a rigid paddle comprising a first side and a second side which is identical to and separate from said first side and contained in its hollow middle is a plurality of sound conducting posts;

b) an elastic removably mounted tether;

c) a resilient ball;

d) an electronic counter that works off the sound created when the ball hits the paddle;

e) a display, wherein said tether elastically connects said paddle and said ball and wherein each impact of said ball with said paddle sounds and is counted and wherein said count is shown on said display, and means for detecting the impact of said ball with said paddle thereby causing said counter to index upward.

2. A counting paddle toy, as recited in claim 1, wherein said counter and display comprise a counter that generates a stream of square waves when switched on, a decade counter that converts said stream of square waves into a binary coded signal, a decoder/driver that converts said binary coded signal into a multiplicity of voltages needed to drive a display, and a display driven by said voltages.

3. A counting paddle toy, as recited in claim 2, wherein said counter comprises a type 555 integrated circuit, said decade counter comprises a type 7490 decade count up counter integrated circuit, and said decoder/driver comprises a type 7446 BCD to 7-segment decoder/driver integrated circuit.

4. A counting paddle toy, as recited in claim 2, wherein said means for detecting the impact of said ball with said paddle creating a sound and thereby causing said counter to count upward comprise a sound transducer located inside said paddle, a circuit for amplifying the output of said transducer, such that a vibration from the impact of said ball with said paddle is caused.

5. A counting paddle toy, as recited in claim 2, wherein said means for detecting the impact of said ball with said paddle thereby causing said counter to index upward comprise a sound transducer, a circuit for amplifying the output of said transducer, a circuit for amplifying the output of said transducer, a circuit for processing said signal such that only certain vibrations are amplified, and a circuit that takes said processed output such that the vibration of the impact of said ball with said paddle causes vibrations that create sound.

6. A counting paddle toy, as recited in claim 5, wherein said circuit for processing said signal such that only certain vibrations are amplified comprises a programmable filter, and a filter program, such that only sounds of a desired frequency corresponding to ball impact and pass through said filter.

7. A counting paddle toy, as recited in claim 6, wherein said hollow body allows the sound to resonate in an amplification chamber which makes the sound reverberate.

8. A counting paddle toy, as recited in claim 7, wherein said tether is removable by providing an aperture in the center of the paddle for the tether to pass through, a screw and a washer in the immediate area of the tether aperture which would allow the tether to be wrapped around or compressed between the surface of the paddle and the underside of the washer when the screw is tightened into the threaded hole, this compression would hold the tether in place.

9. A counting paddle toy, as recited in claim 1, further comprising a sound generator such that the impact of said ball causes said sound generator to emit a sound.

10. A counting paddle toy, as recited in claim 9, wherein said sound generator is a voice synthesizer.

11. A counting paddle toy, as recited in claim 4, wherein said vibrations are conducted to said sound sensor via a multiplicity of sound-conducting ribs.

* * * * *